US006121528A

United States Patent [19]

May

[11] Patent Number: 6,121,528

[45] Date of Patent: Sep. 19, 2000

[54] ELECTROACOUSTICALLY AMPLIFIED DRUM AND MOUNTING BRACKET

[76] Inventor: Randall L. May, 8 Windsor, Newport Beach, Calif. 92660

[21] Appl. No.: 09/237,975

[22] Filed: Jan. 27, 1999

[51] Int. Cl.[7] ..... G10D 13/02

[52] U.S. Cl. ..... 84/411 R; 84/421

[58] Field of Search ..... 84/411 R, 421, 84/420

[56] References Cited

U.S. PATENT DOCUMENTS

| | | | |
|---|---|---|---|
| D. 305,026 | 12/1989 | Wolf | D14/229 |
| 4,168,646 | 9/1979 | May | 84/723 |
| 4,570,522 | 2/1986 | May | 84/723 |
| 4,660,455 | 4/1987 | Jones et al. | 84/413 |
| 5,361,669 | 11/1994 | Genna | 84/414 |
| 5,430,245 | 7/1995 | Rogers | 84/725 |
| 5,949,008 | 9/1999 | Augsburger | 84/421 |

*Primary Examiner*—Paul Ip
*Assistant Examiner*—Kim Lockett
*Attorney, Agent, or Firm*—Neal J. Mosely

[57] ABSTRACT

An electroacoustically-amplified drum assembly consists of a hollow drum shell with a drumhead closing one or both end thereof and an acoustical air vent in the wall thereof. An acoustical microphone is positioned in the drum shell spaced from and free from any connection to the drumhead and has leads for connection through the acoustical vent to an external amplifier and speaker. An adjustable mount is secured on the interior surface of the drum shell without any break in the wall of the drum shell for supporting the microphone. The adjustable mount may be adjusted and set to establish a position for the microphone for minimizing microphone interference and optimizing proximity effect and sound quality. The drum may have air vent hardware positioned in the acoustical air vent opening and including electrical connections for connection to the external speaker and amplifier. The microphone mount may be supported by nuts on the inner ends of lug bolts extending through the drum shell wall for supporting the head tensioning lugs on the outer surface of the drum shell. An alternative embodiment uses magnets one the outer surface of the drum shell cooperating with magnets inside the drum to support the mount adjustably on the drum shell.

29 Claims, 8 Drawing Sheets

U.S. PATENT 4,570,522

ELECTROACOUSTICALLY AMPLIFIED DRUM AND MOUNTING BRACKET

BACKGROUND OF THE INVENTION

1. Field of the Invention

This invention relates to a new and improved electroacoustically amplified drum assembly, and a microphone assembly and mounting bracket therefor.

2. Brief Description of the Prior Art

Conventional drums consist of a hollow drum shell having one or more drumheads held in place by head hoops. Conventional drums are usually not tunable except in a very narrow range by adjustment of the head hoop. Likewise, conventional drums were not been electrically amplified in a satisfactory manner until about 1986.

The placing of an electrical microphone adjacent to the drumhead of a conventional drum was not satisfactory since only the vibrating sound from the drumhead is amplified and there is very little amplification of the resonant components of the sound. The placing of an electric microphone inside a conventional drum previously resulted in the amplification of a mixture of vibratory sounds that amplification that was not musically acceptable.

May U.S. Pat. No. 4,570,522 disclosed an electroacoustically amplified drum assembly consisting of a hollow drum shell with a drumhead closing one or both end thereof. An acoustical microphone was positioned in the drum shell spaced from and free from any connection to the drumhead and had leads for connection to an external amplifier and speaker. An adjustable mount was secured on and extending through the wall of the drum shell for supporting the microphone. The adjustable mount included a mechanism for adjusting the position of the microphone for minimizing microphone interference and optimizing proximity effect and sound quality. A product has been produced and sold in the U.S. and some foreign countries during the time since that patent was granted.

The inventor developed this invention as an improvement on his prior patent '522 to facilitate the production of electroamplified drums from standard commercially available drums.

The prior art cited in the May '522 patent or cited against it by the Examiner is the best prior art known to the inventor relative to the '522 patent: Green U.S. Pat. No. 3,509,264; Dominguez et. al. U.S. Pat. No. 3,553,339: Ebihara et. al. U.S. Pat. No. 3,596,959; Parsons U.S. Pat. No. 3,008,367; Rizutti U.S. Pat. No. 3,192,304; Kaminsky U.S. Pat. No. 3,549,775; Glenn et. al. U.S. Pat. No. 3,551,580; May U.S. Pat. No. 4,168,646; Barber, Jr. et al. U.S. Pat. No. 4,201,107; Hyakutake U.S. Pat. No. 4,226,156; and Pozar U.S. Pat. No. 4,242,937.

U.S. Patents issued since applicant's prior patent (May '522) that are relevant to this invention are:

Rothmel U.S. Pat. No. 5,105,710 discloses a drum having a tuned electronic drum pad.

Volpp U.S. Pat. Nos. 5,353,674 and 5,606,142 each disclose a drum having a microphone mounted on the drum shell.

Rogers U.S. Pat. No. 5,430,245 discloses a drum having a transducer mounted inside the shell.

The following U.S. patents show the internal milking of stringed instruments:

Wendler U.S. Pat. No. 4,941,389 discloses a stringed instrument with a magnet inside positioned to respond to vibration of the strings.

Winkler U.S. Pat. No. 5,194,686 discloses another stringed instrument with a magnet inside positioned to respond to vibration of the strings.

Donnell U.S. Pat. No. 5,010,803 discloses still another stringed instrument with a microphone inside positioned to respond to vibration of the strings.

SUMMARY OF THE INVENTION

It is therefore an object of the present invention to provide to provide a new and improved drum assembly having improved means for supporting a microphone inside a drum shell for electroacoustical amplification.

Another object of this invention is to provide an improved tunable drum assembly including means for electroacoustical amplification having supporting means that does not require penetration of the shell.

Another object of the invention is to provide an electroacoustical amplification of a drum by means of a microphone mounted within the drum shell on an adjustable mount that permits movement of the microphone for tuning and having supporting means that does not require penetration of the shell.

Another object of this invention is to provide an improved mounting bracket for use with drum shells that provides for adjustment of the position and orientation of a microphone within a drum shell and having supporting means that does not require penetration of the shell.

Another object of this invention is to provide an improved microphone assembly for a drum shell including a bracket mountable on the shell that provides for adjustment of position and orientation of the microphone and having supporting means that does not require penetration of the shell.

Another object of this invention is to provide an improved tunable drum assembly including means for electroacoustical amplification having a support mounted on the inner ends of the bolts for the lugs for mounting the drum tensioning hoops and does not require penetration of the shell.

Another object of the invention is to provide an electroacoustical amplification of a drum by means of a microphone mounted within the drum shell on an adjustable mount that permits movement of the microphone for tuning and having a support mounted on the inner ends of the bolts for the lugs for mounting the drum tensioning hoops and does not require penetration of the shell.

Another object of this invention is to provide an improved mounting bracket for use with drum shells that provides for adjustment of the position and orientation of a microphone within a drum shell and having a support mounted on the inner ends of the bolts for the lugs for mounting the drum tensioning hoops and does not require penetration of the shell.

Another object of this invention is to provide an improved microphone assembly for a drum shell including a bracket mountable on the shell that provides for adjustment of position and orientation of the microphone and having a support mounted on the inner ends of the bolts for the lugs for mounting the drum tensioning hoops and does not require penetration of the shell.

Another object of this invention is to provide an improved tunable drum assembly including means for electroacoustical amplification having a magnetic supporting means that does not require penetration of the shell.

Another object of the invention is to provide an electroacoustical amplification of a drum by means of a microphone mounted within the drum shell on an adjustable mount that permits movement of the microphone for tuning and having an adjustably positionable magnetic supporting means that does not require penetration of the shell.

Another object of this invention is to provide an improved mounting bracket for use with drum shells that provides for adjustment of the position and orientation of a microphone within a drum shell and having an adjustably positionable magnetic supporting means that does not require penetration of the shell.

Another object of this invention is to provide an improved microphone assembly for a drum shell including a bracket mountable on the shell that provides for adjustment of position and orientation of the microphone and having an adjustably positionable magnetic supporting means that does not require penetration of the shell.

Another object of this invention is to provide an improved tunable drum assembly including means for electroacoustical amplification having a two-part magnetic support mounted on the outside and inside of the shell that does not require penetration of the shell.

Another object of the invention is to provide an electroacoustical amplification of a drum by means of a microphone mounted within the drum shell on an adjustable mount that permits movement of the microphone for tuning and having a support having an adjustably positionable magnetic supporting means that does not require penetration of the shell.

Another object of this invention is to provide an improved mounting bracket for use with drum shells that provides for adjustment of the position and orientation of a microphone within a drum shell and having a support with exterior and interior magnets mounted on the outside and inside of the shell and does not require penetration of the shell.

Another object of this invention is to provide an improved microphone assembly for a drum shell including a bracket mountable on the shell that provides for adjustment of position and orientation of the microphone and having a support secured on the shell by an exteriorly positioned magnet and interiorly positioned magnet that permit adjustment of position and does not require penetration of the shell.

Other objects of the invention will become apparent from time to time throughout the specification and claims as hereinafter related.

The above noted objects and other objects of the invention are accomplished by an electroacoustically amplified drum assembly which consists of a hollow drum shell with a drumhead closing one or both ends thereof and lugs positioned around the shell supported on threaded lugs or bolts penetrating the shell connected to tensioning lugs for tuning the drumheads.

An acoustical microphone is positioned in the drum shell spaced from and free from any connection to the drumhead and has leads for connection to an external amplifier and speaker. An adjustable mount is supported on the inner ends of the lugs extending through the wall of the drum shell that support the drumhead tensioning lugs, for supporting the microphone.

The adjustable mount includes a mechanism for adjusting the position of the microphone for minimizing microphone interference and optimizing proximity effect and sound quality. An alternate embodiment has a two-part magnetic support for the base of the adjustable mount that required no penetration of the drum shell.

BRIEF DESCRIPTION OF THE DRAWINGS

FIG. 9 is an exploded view and

FIG. 10 an assembled view of the audio vent connector on the drum shell as the first step in assembly.

FIG. 11 is an exploded view of the microphone rotation assembly, the connector plate, and the audio connector that are assembled into a subassembly and mounted on the inside of the drum shell.

FIG. 12 is an isometric view of the inside of the drum shell with the subassembly produced in FIG. 11 mounted on the inner ends of the supporting bolts on the drum tensioning lugs.

FIG. 13 is an exploded view of internal and external magnets for supporting the microphone-supporting bracket on the drum shell in a vertical position as viewed from inside the shell.

FIG. 14 is an exploded view of internal and external magnets for supporting the microphone-supporting bracket on the drum shell in an angular position as viewed from inside the shell.

FIG. 15 is an exploded view of internal and external magnets for supporting the microphone-supporting bracket on the drum shell in a vertical position as viewed from outside the shell.

FIG. 16 is an exploded view of internal and external magnets for supporting the microphone-supporting bracket on the drum shell in an angular position as viewed from outside the shell.

FIG. 17 is an isometric view of the external magnets positioned to support the microphone-supporting bracket on the drum shell in a vertical position as viewed from outside the shell.

FIG. 18 is a detail view of the external magnets positioned to support the microphone-supporting bracket on the drum shell in a vertical position as viewed from outside the shell as in FIG. 17.

FIG. 19 is an isometric view of the external magnets positioned to support the microphone-supporting bracket on the drum shell in an angular position as viewed from outside the shell.

FIG. 20 is a detail view of the external magnets positioned to support the microphone-supporting bracket on the drum shell in an angular position as viewed from outside the shell as in FIG. 19.

FIG. 21 is an isometric view of internal magnets assembled to support the microphone-supporting bracket on the drum shell in a vertical position as viewed from inside the shell.

FIG. 22 is an isometric view of external magnets assembled to support the microphone-supporting bracket on the drum shell in a vertical position at a different location as viewed from inside the shell.

FIG. 23 is an isometric view of internal magnets assembled to support the microphone-supporting bracket on the drum shell in a vertical position as viewed from inside the shell.

FIG. 24 is an isometric view of external magnets assembled to support the microphone-supporting bracket on the drum shell in an angular position at a different location as viewed from outside the shell.

DESCRIPTION OF THE ILLUSTRATED PRIOR ART EMBODIMENTS

Figure 1:
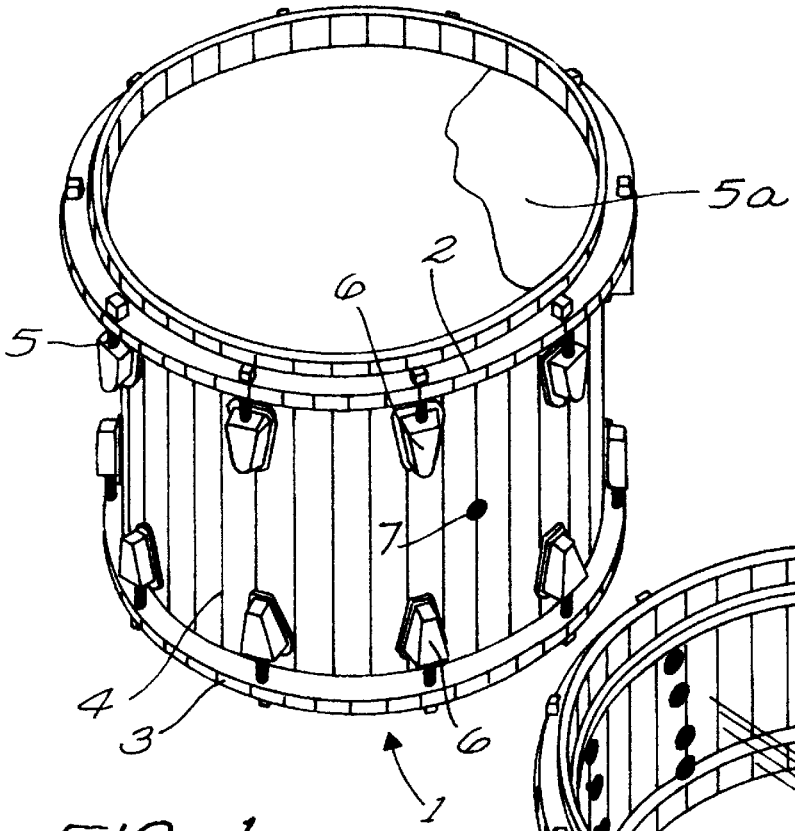
FIG. 1 is an isometric view of a standard unmodified drum assembly (PRIOR ART) without microphone, amplifier and speaker showing the drumhead supporting and tuning exterior lugs.
Figure 2:
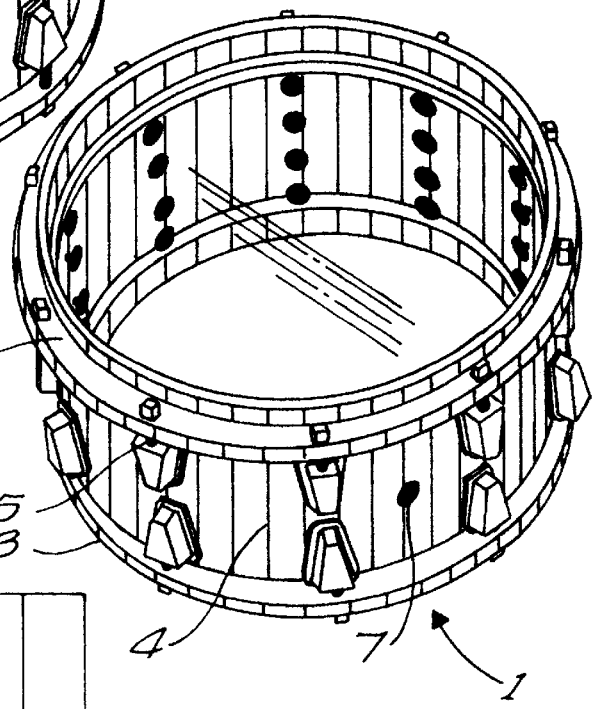
FIG. 2 PRIOR ART
FIG. 2 is an isometric detail view of another standard unmodified drum shell (PRIOR ART) similar to FIG. 1 but showing the nuts securing the inwardly extending bolts for the supporting lugs.
Figure 3:
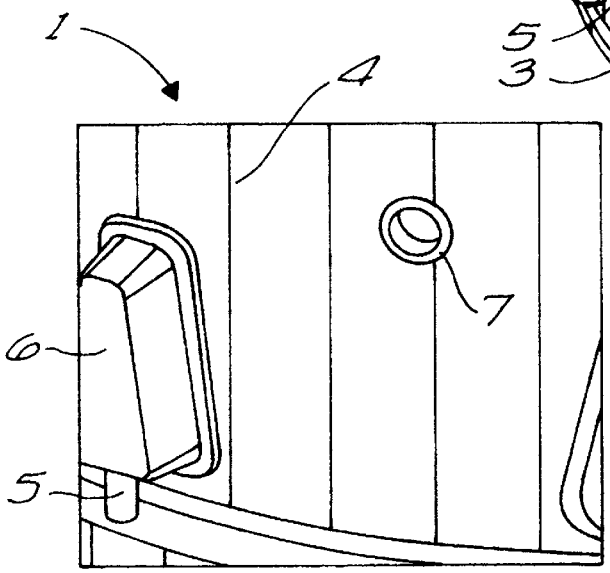
FIG. 3 is a detail view of the drum shell of FIG. 1 or FIG. 2 showing the acoustical vent opening.

Referring to the drawings by numerals of reference, and more particularly to FIGS. 1, 2 and 3, there is shown a drum assembly 1, or PRIOR ART design, without electroacoustical amplification to be modified in accordance with this invention. In FIGS. 1 and 2, the drum assembly 1 consists of upper and lower drum tensioning hoops 2 and 3 that are supported on drum shell 4. Drum tensioning hoops 2 and 3 are secured on the drum shell 4 by conventional adjusting screws 5 that secure them to lugs 6 on drum shell 4. Adjustment of the bolts or screws 5 varies the tension in the drumhead skin or diaphragm 5*a* to tune the sound output of the drumheads.

Drum shell 4 has an acoustical vent opening 7 that allows air to exit from the interior of the drum, avoiding a dampening of the sound that would occur in a tightly closed drum. In the preferred embodiments of the invention, the construction shown in FIGS. 1–3 has an internal microphone added on a support that does not require penetration of the drum shell and does not affect or restrict air exiting from the interior of the drum.

Drum Assembly of May U.S. Pat. No. 4,570,522 (PRIOR ART)

Figure 4:
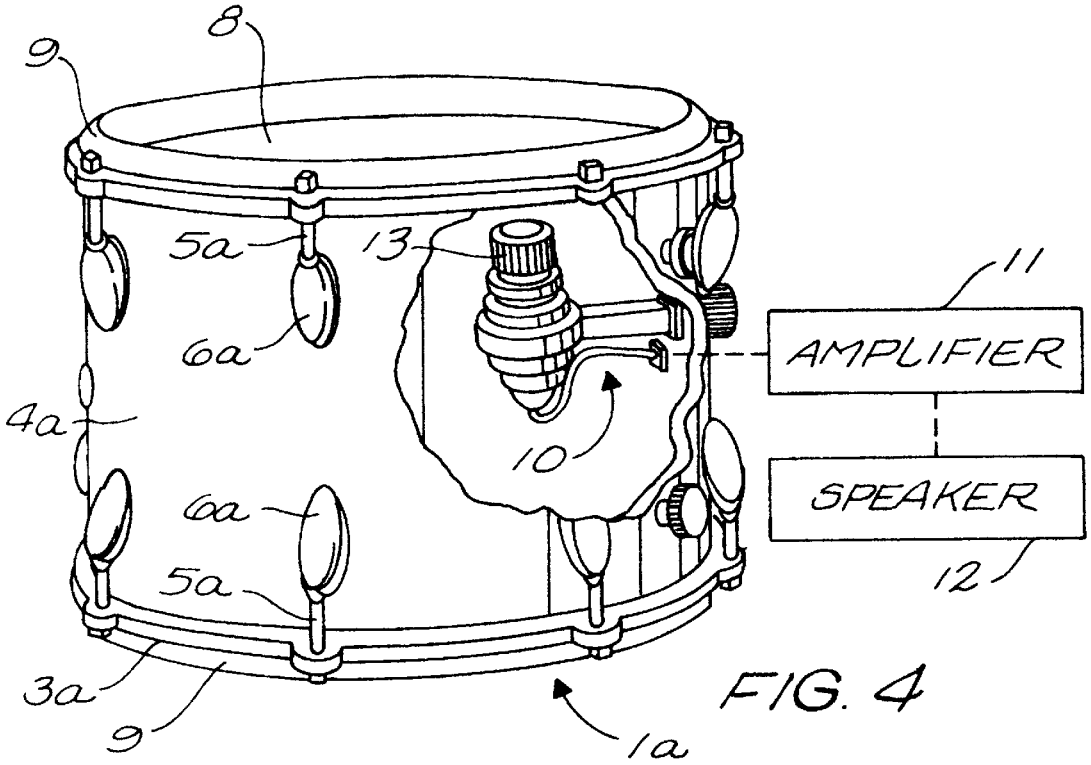
FIG. 4 PRIOR ART
FIG. 4 is an isometric view of a drum assembly provided with a microphone and schematically connected to an amplifier and speaker as shown in May U.S. Pat. No. 4,570,522.
Figure 5:
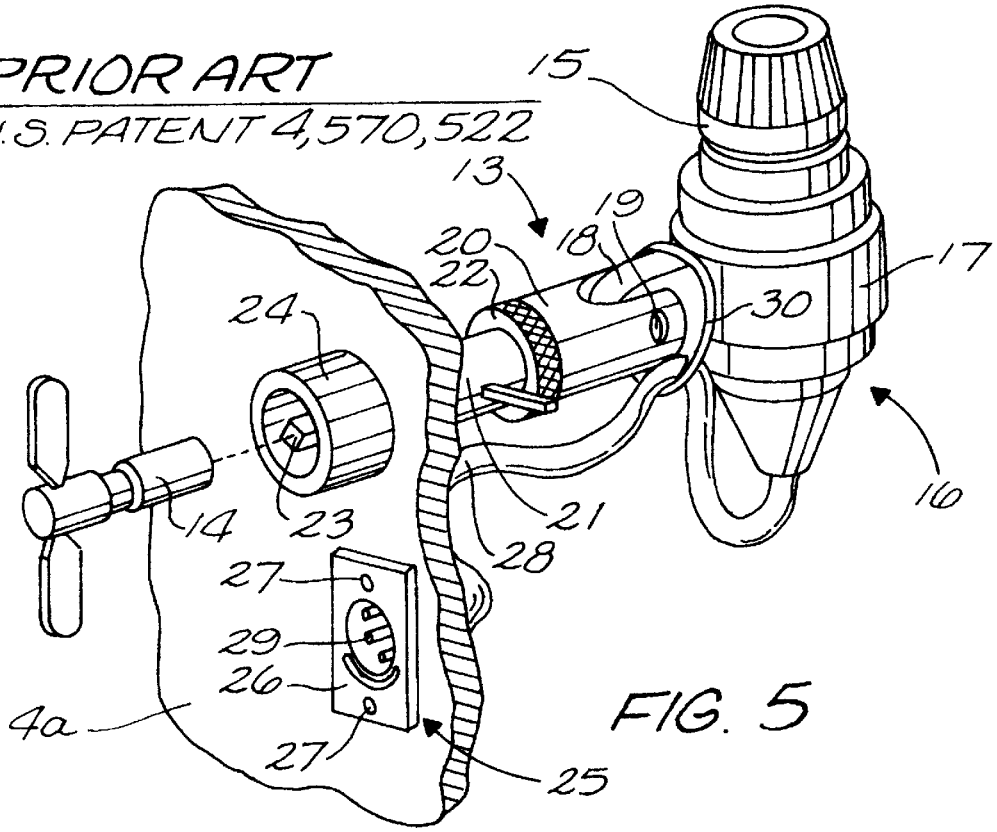
FIG. 5 is an isometric detail view of a portion of the drum shell and microphone of May U.S. Pat. No. 4,570,522 as shown in FIG. 4, above.

FIGS. 4 and 5, shown herein, correspond to FIGS. 1 and 2 of May U.S. Pat. No. 4,570,522. These Figures are shown here to contrast a drum with internally supported microphone where the support requires penetration of the drum shell with the present invention that does not require penetration of the drum shell.

In FIG. 4, there is shown a drum assembly 1*a* that has provided for electroacoustical amplification. In FIG. 4, the drum assembly 1*a* consists of upper and lower tensioning hoops 2*a* and 3*a* that are supported on drum shell 4*a*. Drum heads 8 and 9 are secured by tensioning hoops 2*a* and 3*a*. Drum heads 8 and 9 are secured on the drum shell by conventional adjusting screws 5*a* that secure the tensioning hoops 2*a* and 3*a* to lugs 6*a* on drum shell 4*a*. Adjustment of the bolts or screws 5*a* varies the tension in the drum skin or diaphragm of drumheads 8 and 9 to tune the output of the drumheads.

A microphone assembly 10 positioned inside the drum shell 4*a* is connected to an external amplifier 11 and speaker 12. The connection to the amplifier 11 and speaker 12 is by means of a conventional jack and connector wire. Microphone assembly 10 includes a microphone 13 that is movable inside the drum shell by means of an external adjusted mechanism to tune the sound output from the drum to the amplifier 11 and speaker 12. Details of construction of microphone assembly 18 and microphone 21, as well as the supporting and adjusting mechanism therefor as shown further in FIG. 5 described below.

In FIG. 5, microphone assembly 13 is installed on drum shell 4*a* with a drum key 14 in exploded relation thereto. Drum microphone assembly 13 consists of microphone 15 supported in shock mount 16 having a hollow, annular supporting portion 17 with a tongue abutment 18 extending laterally therefrom. Tongue 18 is supported in a clevis 20 on pivot bolt 19 that provides for pivotal or elliptical movement of the shock mount 16 and microphone 15.

Clevis 20 is internally threaded (not shown) and receives the enlarged threaded end portion of mike rotation shaft 21. A lock nut 22 secures mike rotation shaft tightly on clevis 20 after being screwed in place. The outermost end of mike rotation shaft 21 comprises a male adjustment portion 23 of square cross section that fits a like recess in drum key 14. A hole in drum shell 4*a* has a tubular nylon brushing through which mike rotation shaft 21 extends. Shaft 21 is retained in position by an external locking knob 24.

A jack housing 25 consists of an external plate 26 with a tubular extension extending through an aperture in drum shell 4*a*. When jack housing 25 is positioned in place, holes 27 are aligned with like holes in drum shell 4*a* and holes in the stop plate. Setscrews are positioned through the aligned holes and have star washers positioned to assist in securing nuts against coming lose. A lead or wire 28 extends from microphone 15 to a three-post jack 29. Lead wire 28 is secured adjacent to microphone 15 by wire tie 30.

The microphone-supporting assembly in this drum may be assembled and installed at the time of manufacture or may be installed later by the user (retrofitted) and has the disadvantage that holes have to be cut in the drum shell. The present invention, as described below, does not require penetration of the drum shell and can be retrofitted as well as installed at the time of manufacture.

Description of One Preferred Embodiment

Figure 6:
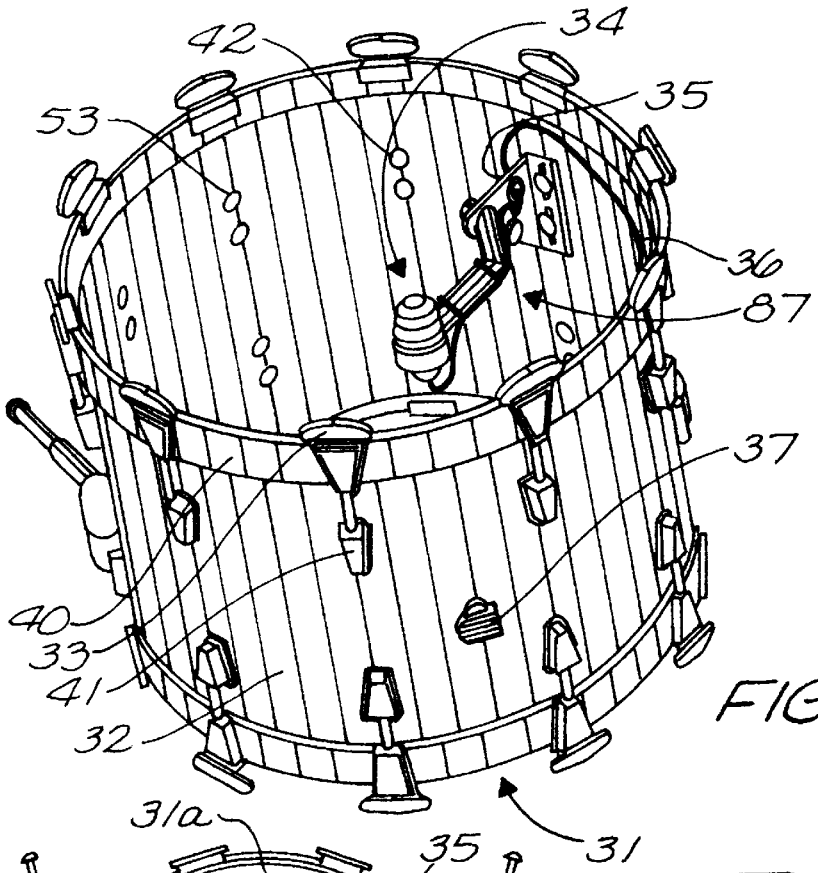
FIG. 6 is an isometric view of the bottom side of a preferred embodiment showing a bass drum assembly and mounting bracket for a drum assembly.
Figure 7:
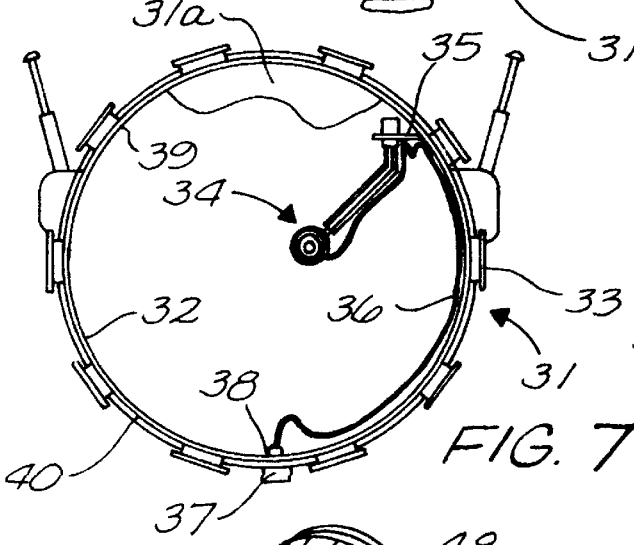
FIG. 7 is a view of the drum assembly and mounting bracket for the bass drum shown seen from the bottom of FIG. 6.

Referring to the drawings by numerals of reference, and more particularly to FIGS. 6 and 7, there is shown a drum 31 with provisions for electroacoustical amplification. Drum 31 is a bass drum, although the invention may be used with snare drums and other drums. In FIG. 6, the drum 31 is shown lying on its side and, when assembled, has drumheads 31*a* that are supported on drum shell 39. The drumheads 31*a* are secured on the drum shell by thumbscrews 33 that secure tensioning hoops 40 to tensioning lugs 41.

Lugs 41 are internally threaded to receive retaining screws or bolts 42 extending through holes in the wall of drum shell 39 and washers 53 located between the bolts and the drum shell. An alternative means for securing tensioning lugs 41 in place would utilize bolts integral with the lugs extending through the holes in the drum shell 39 and nuts securing the lugs in place. Adjustment of the thumbscrews 33 varies the tension in the drum skin or diaphragm to tune the output of the drumheads 31*a*.

Figure 8:
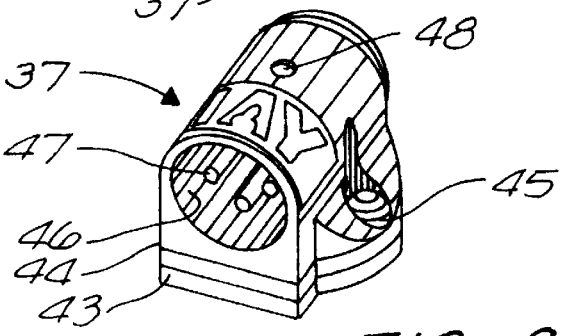
FIG. 8 is a detail isometric view of an audio vent connector on the bass drum assembly shown in FIGS. 6 and 7.

A microphone assembly 34 is supported inside the drum shell 39 on supporting plate 35 and connected by cable 36 through acoustical vent opening 38 and audio vent connector 37 (see FIGS. 8–10 for details) to an external amplifier (not shown, but see FIG. 4) and speaker (not shown but see FIG. 4). This assembly and mode of support is shown in more detail in FIGS. 11 and 12.

Audio vent connector 37 has a base plate 43 and a main body portion 44 secured together by mounting screws 45. Main body portion 44 has a cylindrical passage 46 extending longitudinally therethrough with a three-post male jack receptacle 47 secured therein by a setscrew 48. A hollow, externally threaded bolt 49 is secured in audio vent connector 37 and extends downwardly at a right angle thereto. Microphone cable 36 extends through hollow bolt 49 and is connected to the rear of the three posts of jack receptacle 47.

Figure 9:
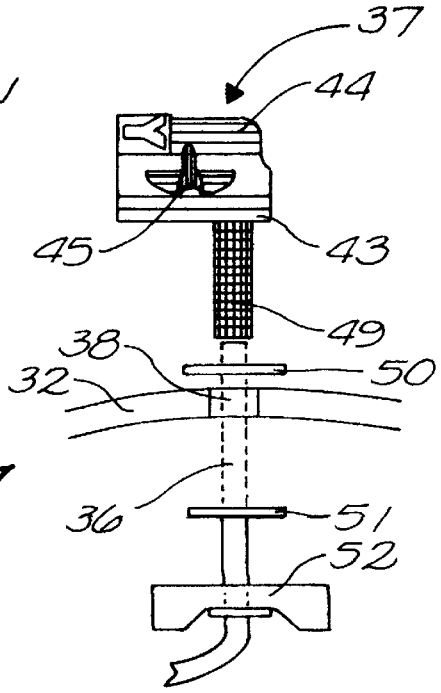
FIGS. 9–12 show details of the drum assembly and mounting bracket in the sequence of assembly and mounting inside the drum shell.

In assembling the drum, the assembly of audio vent connector 37 is carried out first. In FIG. 9, the audio vent connector is shown in exploded relation to drum shell 32, with washers 50 and 51 positioned to fit hollow bolt 49 on the outside and inside of the drum shell, to be secured thereon by wing nut 52 and with audio cable secured in place.

Figure 10:
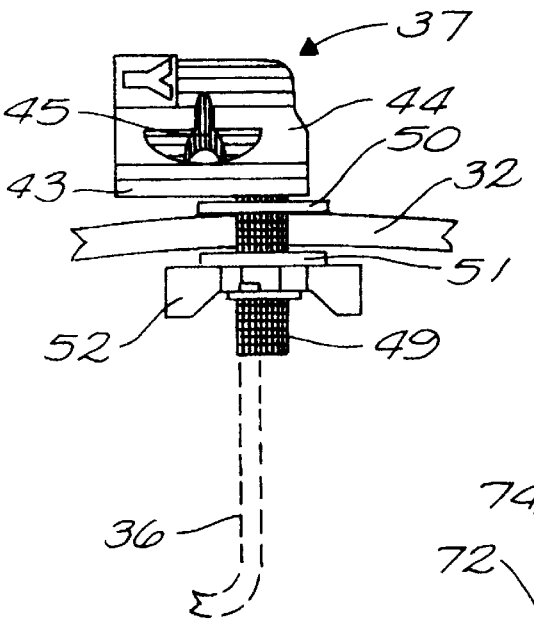

In FIG. 10 the audio vent connector 37 is shown assembled on drum shell 32. Wing nut 52 is tightened to hold connector 37 securely in place with washer 50 positioned between connector base 43 and drum shell 32 and washer 51 positioned between wing nut 52 and drum shell 32. The size of the passage 46 in audio vent connector 37 and the size of the opening in hollow bolt 49 are such that air may flow in and out of the drum, allowing it to "breath" and avoid the problem of sound dampening in a tightly enclosed drum. Audio vent connector 37 may be set at any desired angular position on the drum shell 32.

Figure 11:
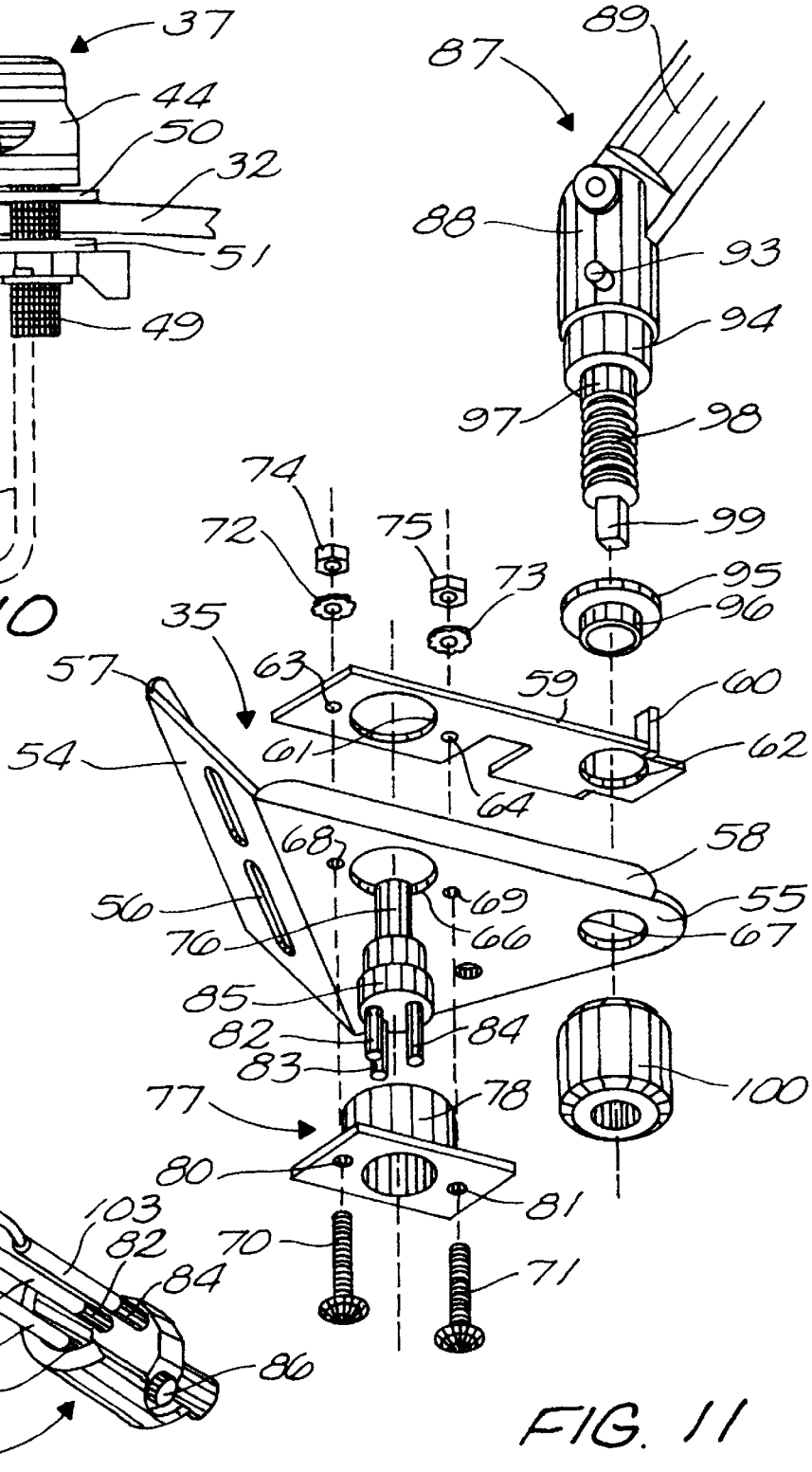
Figure 11A:
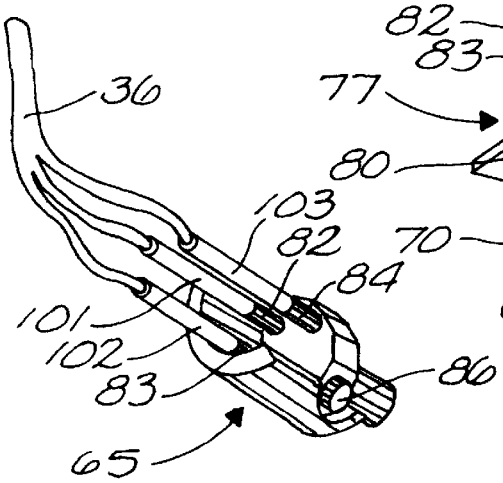
FIG. 11A is an isometric view of a subassembly of the cable connection for the microphone.

In FIG. 11, the components of the microphone rotation mechanism and the support connector plate 35 are shown in exploded relation ready for assembly. Supporting plate 35 is of a dihedral shape with flat plate portions 54 and 55 meeting at an obtuse angle. Plate portion 54 has slots 56 for receiving lug-securing bolts 42 to secure the plate to the inside of drum shell 32 with plate portion 55 extending at an angle for supporting the microphone rotation assembly spaced from the wall of the drum shell.

Plate portions 54 and 55 have bent edge portions 57 and 58 respectively. Holes 66 and 67, and bolt holes 68 and 69, in plate member portion 55 are located to receive components of the audio connector assembly and the microphone rotation assembly to be secured together by bolts 70 and 71, washers 72 and 73, and nuts 74 and 75.

A spacer plate 59, positioned for assembly on supporting plate 35, has a limit stop member 60, holes 61 and 62 aligned with holes 66 and 67 in plate portion 55, and bolt holes 63 and 64 aligned with bolt holes 68 and 69 in plate portion 55.

Microphone connector 65 has tubular member 76 positioned for support in connector 77 having a tubular portion 78 secured on mounting plate 79. Holes 80 and 81 in plate 79 are spaced to align with holes 68 and 69 in plate portion 55 and holes 63 and 64 in plate 59. Tubular member 76 receives cable from the microphone connected to the upper ends of posts 82, 83 and 84 in cylindrical connector block 85 which is secured in place by set screw 86.

Microphone rotation assembly 87 has articulated members 88 and 89 (in FIG. 11), and 90 (in FIG. 12) pivotally connected at 91 and 92 for adjustment in two different directions. Member 88 has a limit pin 93 and a reduced diameter portion 94 that fits against bushing 95. Bushing 95 has a tubular extension 96 that assembles into holes 62 and 67 in plates 59 and 55. Member 88 has further reduced portion 97 threaded at 98 and a square cross section end portion 99 for receiving an internally threaded knob 100.

Assembly of supporting plate 35 and microphone rotation assembly 87 are as follows:

Spacer plate 59 is positioned on flat plate portion 55 of supporting plate 35 against bent edge portion 58 with holes 61 and 62 aligned with holes 66 and 67, in plate portion 55, and bolt holes 63 and 64 aligned with bolt holes 68 and 69 in plate portion 55. Cylindrical connector block 85 is inserted in the upper end of tubular portion 78 of connector 77 and secured by set screw 86 with posts 82, 83 and 84 extending therefrom.

Figure 12:
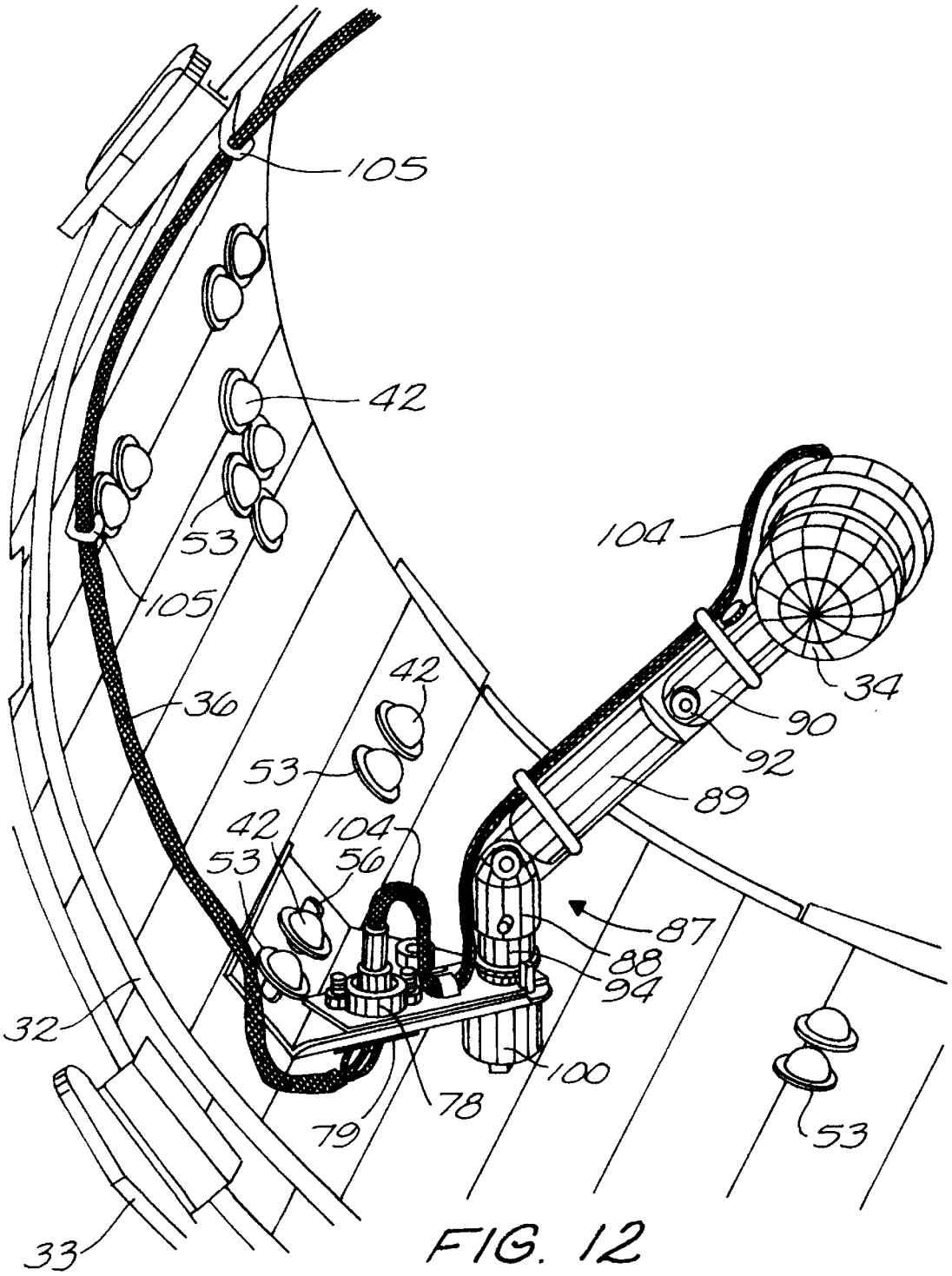

Connector 77 is then assembled with plate 79 abutting the plate portion 55 of support 35 aligning bolt holes 80 and 81 with bolt holes 68 and 69 in plate portion 55 and bolt holes 63 and 64 of plate 59. Bolts 70 and 71 are then inserted through the respective bolt holes; washers 72 and 73 placed on the bolts and nuts 74 and 75 screwed on the ends of the bolts and tightened to secure the entire microphone connector together (as seen in FIG. 12). Cable terminals 101, 102 and 103 are pressed on the posts 82, 83 and 84 in the audio connector.

Microphone rotation assembly 87 is mounted on supporting plate 35 by inserting the end 97, 98 extending through bushing 95 and inserting bushing extension 96 through holes 62 and 67. Knob 100 is then threadedly secured on the end portion 98 with square end portion 99 protruding therefrom and, when tightened, locks the articulated member 88 in place. Rotation of the square end portion 99 of inner articulated member 88 rotates the entire microphone assembly. The square end portion 99 is turned by a square key used for adjusting the screws used for varying the tension of the drumheads 31*a*.

The assembly is then secured inside the drum shell 32 using one or two of the bolts 42 that secure the tensioning lugs 41 on the drum. The bolt(s) 42 have washer(s) 53 positioned thereon before inserting them through slot(s) 56 into the threaded holes in lug(s) 41. When these bolts 42 are tightened against plate portion 54, the supporting plate 35 is secured tightly on the inside of drum shell 32 with plate portion 55 extending at an angle away from the inner surface of the drum shell (FIG. 12). Washers may be placed on bolts 42 between the drum shell 32 and supporting plate 35 to space the assembly away from the drum shell.

When lugs are used with integral threaded bolt extensions positioned through the drum shell and secured by nuts inside the drum shell, the microphone supporting plate 35 may be supported on the threaded ends on the bolt extensions beyond the nuts threaded thereon to space the support assembly further from the wall of the drum shell.

Microphone 34 is connected by three-strand cable 104 to the upper tubular portion 78 and the terminal posts 82, 83 and 84. Cable terminals 101, 102 and 103 pressed on the posts 82, 83 and 84 in the audio connector, connect microphone 34 to cable 36 and to audio vent connector 37. Cable ties 105 secure the cable 36 along the inner surface of drum shell 32. Cable terminals 101, 102 and 103 are pressed on the posts 82, 83 and 84 in the audio connector.

The following theoretical discussion is taken from May U.S. Pat. No. 4,570,522 to facilitate understanding of this invention:

Factors in Microphone Design and Placement

Three of the major factors involved in the design and placement of microphones are polar response of a microphone, microphone interference, and proximity effect. A microphone polar response is an indication of its sensitivity to sounds originating at any point along the circumference of a circle drawn around the microphone. Microphone interference, which is also called acoustic phase cancellation, results from misplacement of a microphone so that sounds are received at different times. Proximity effect is the variation in frequency response caused by a variation in working distances from the microphone.

The problem of polar response of a microphone is mostly one that concerns a cardioid or unidirectional microphone. Microphone polar patterns may be divided into three main categories, viz. Unidirectional (cardioid), bidirectional and omnidirectional.

In measuring polar response of microphones, the polar response curve is usually drawn on a piece of circular graph paper with approximately five progressively larger circumferences. Each circumference usually indicates a difference of sensitivity of five decibels from the next adjacent circumference. The radial lines on such a graph indicate the direction from the microphone.

If such a graph is examined showing a curve for a cardioid or unidirectional microphone, it is noted that the response curve touches the outer circumference from the point labeled 0° to a point just before the 60° mark to either side. From thereon, the curve slopes inward until at the 180° point it touches one of the innermost circumferences on the other side of the 180° point, the curve is a mirror image of the section just described.

If one considers the example of a constant level point source of sound located at the 0° point on the outer circumference, as the sound source moves along the circumference toward the 60° degree mark no change in sound level occurs at the microphone. As the sound source moves beyond the 60° point, it would have to move progressively closer to the microphone in order for the sound level arriving at the output of the microphone to remain the same. If the sound source remains at the same distance at the 180° point that it was at 0°, the microphone would attenuate the sound by 20 decibels (in this particular example).

In plotting the polar response of a microphone, the sound source is usually in a fixed location and the microphone is rotated at a fixed distance. This can be carried out for any type of microphone although the graph produced is different for unidirectional microphones, bidirectional microphones and omni-directional microphones.

The problem of microphone interference can be seen by examining the problem of the positioning of the sound source between two separate microphones or the positioning of a single microphone between various sound sources.

If two microphones are placed in spaced relation, a sound source must be positioned exactly equidistant between them to produce an accurate reproduction of the sound. If the sound source is positioned exactly in a central location and not changed in direction it will not be distorted by separate microphones. However, if the sound source is moved or changed in orientation with respect to the microphones an acoustic phase cancellation takes place, which results in distortion of the sound reproduced by the microphones. A similar effect takes place and a single microphone is varied in position relative to separate sources of sound.

If two microphones must be used to produce a wide angle of acceptance to cover a moving sound source, it is preferred to have the microphones relatively close together and point it at an angle to provide an angle of acceptance of about 90°–180°. As an example of the problem that it had encountered, consider the situation of positioning a number of microphones in relation to enlarge orchestras. If one musician is working about two feet from his microphone, the next adjacent microphone should be at least 6 feet away. This three to one racial of spacing was established after a long series of test and is reported in the literature dealing with microphone design and application.

The variation in frequency response caused by a variation in working distance from the microphone is known as proximity effect. This variation occurs in the low frequencies at distances of about 2 feet or less. The proximity effect characteristics of a single diaphragm microphone may be put to good use if the microphone is used correctly. This effect may add depth and fullness to a thin sound source. The distance should be closely maintained, however, once an effective working range is found, so that the boosted low-end response remains constant.

The electroacoustic amplified drum assembly described above can be plugged into live or studio boards. This equipment mikes the internal acoustics of the drum and amplifies in which it is mounted. This eliminates microphone leakage phase cancellation. The microphone can be rotated 180°, which allows each drum to be individually equalized to balance tone and volume and to isolate a wide range of internal frequencies.

Assembly and Operation

The assembly of the drum and microphone as described above for the embodiment of FIGS. 6–12 follows the theory discussed above and has the advantage that the drum shell does not have to be penetrated to mount the microphone supporting and rotating mechanism. The square end 99 can rotate the assembly to the desired position while joints 91 and 92 and the pivoted support of microphone 34 allow the microphone to be positioned as desired.

To assemble the apparatus on an existing drum (called retrofitting), the drum set is first set up as under normal playing conditions. Next, all batter heads and hoops are removed. One then determines the location on the drum shell for placement of the electroacoustical amplification apparatus. The acoustic and electroacoustic sound properties are not affected by the radial location of the milking system. One must keep in mind, however, the accessibility of external cables and jacks or snakes when determining location.

In this apparatus, the internal connection of the drum cable and the three-post jack provided in the audio vent connector allows for direct connection of the drum to the external amplifier and speaker. On the other hand, if the drum does not have the audio vent connector and it is not convenient to install one, the cable 36 from the microphone can be passed through the standard vent hole and a jack provided on its end for connection to the amplifier and speaker system.

This electroacoustical system is effective to reproduce accurately a wide range of frequencies. Consequently, it will perform only as well as the drums are tuned. It is usually necessary on determining the desired pitch of each drum that each head be accurately tuned to itself. If necessary, drumheads may be replaced. If the drum is normally dampened to shorten the fundamental tone, it will still be necessary to use damping procedures as the amplification system has no effect on the length of the fundamental.

This amplification system is effective to isolate a wide range of frequencies with its cardioid pick-up pattern. Coupled with the radial rotation by means of microphone rotation knob 100, it is possible to isolate the frequency response to best reproduce the desired tonality of each drum.

The system, as designed, allows each drum to be individually equalized (boost and/or cut off high and low frequencies). Acoustic equalization is achieved by rotating microphone 34 and also taking advantage of proximity effect, i.e. a variation in frequency response caused by variation in working distance from the microphone. To rotate microphone 34, one drumhead 31*a* is removed and the microphone rotated by knob 100 and suitable adjustments made to the articulated support.

Description of Another Embodiment

Figure 13:
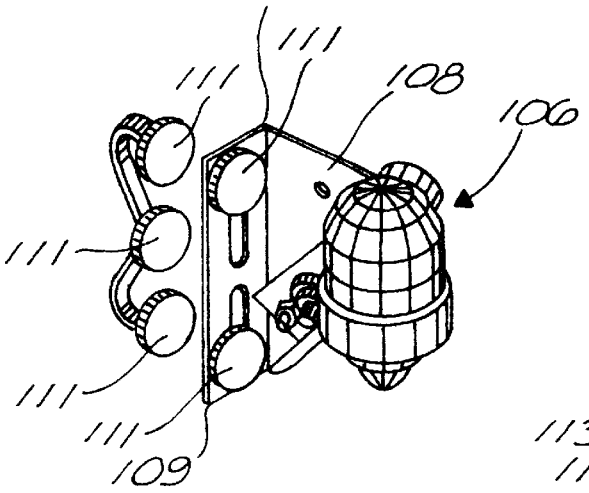
FIGS. 13–24 show details of the drum assembly and mounting bracket in the sequence of assembly and mounting inside the drum shell (in this case, a snare drum) by means of a magnetic mounting bracket support.
Figure 14:
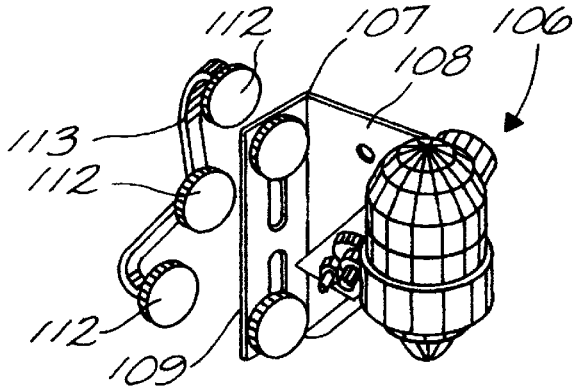
Figure 15:
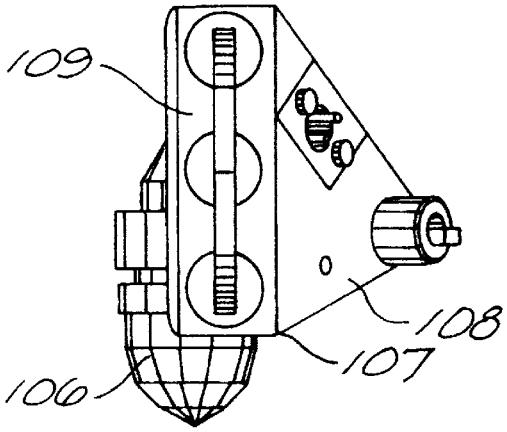
Figure 16:
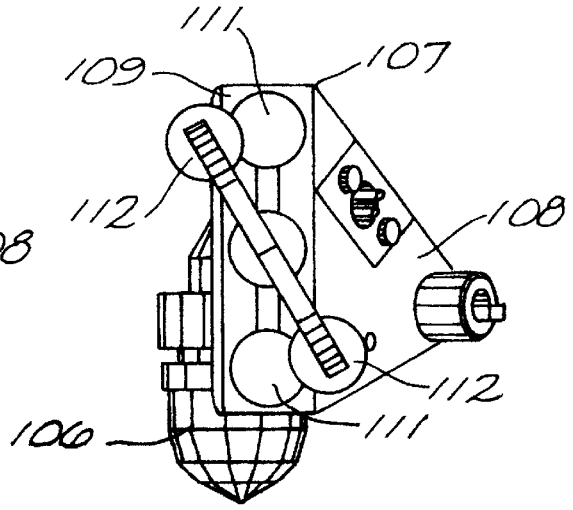
Figure 17:
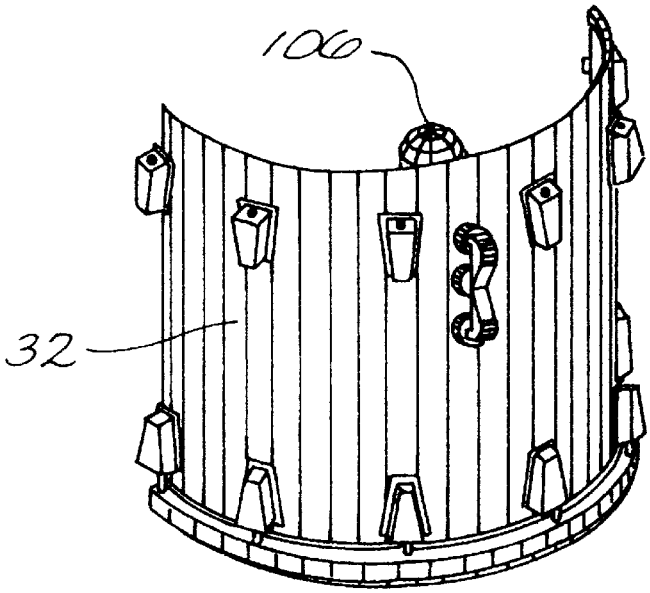
Figure 18:
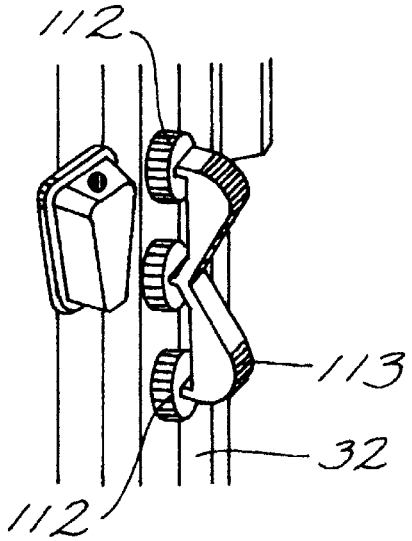
Figure 19:
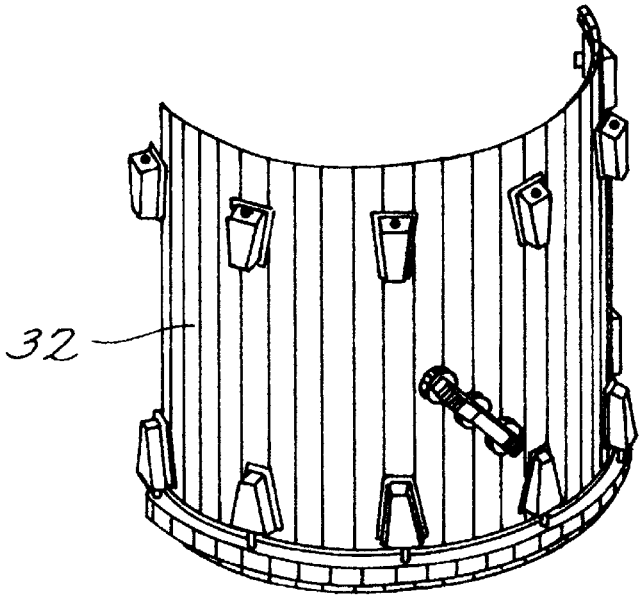
Figure 20:
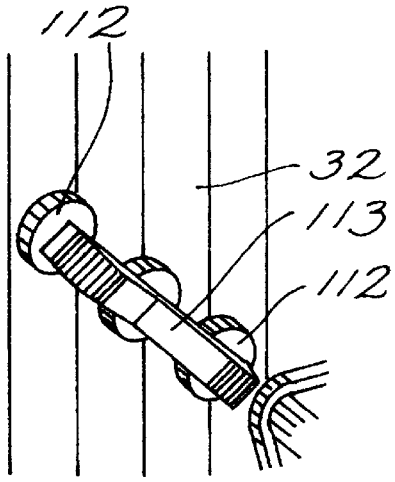
Figure 21:
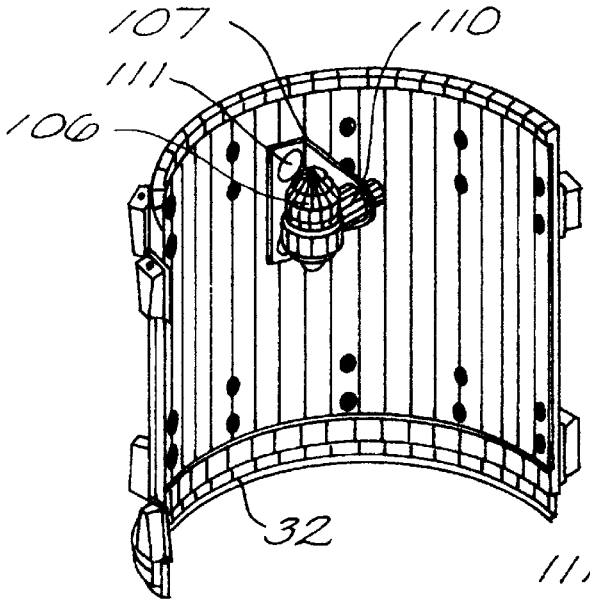
Figure 22:
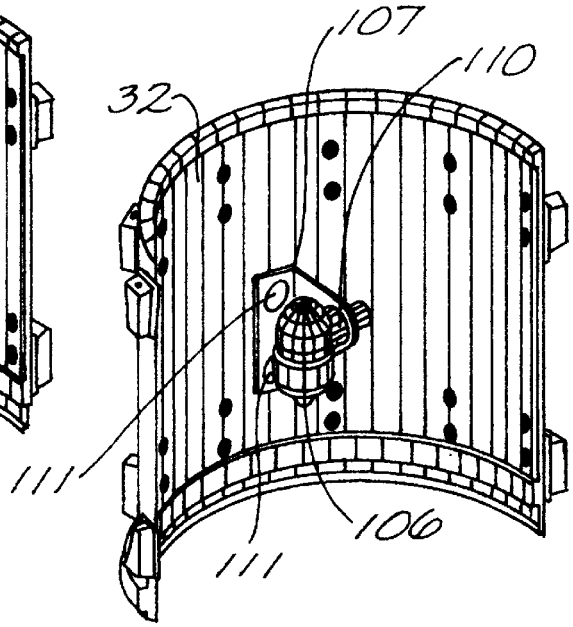
Figure 23:
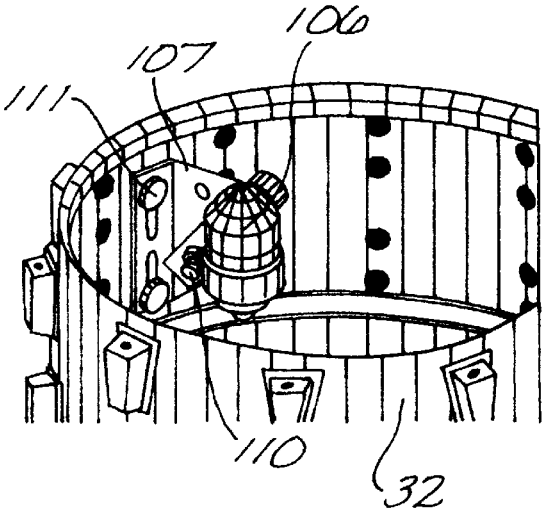
Figure 24:
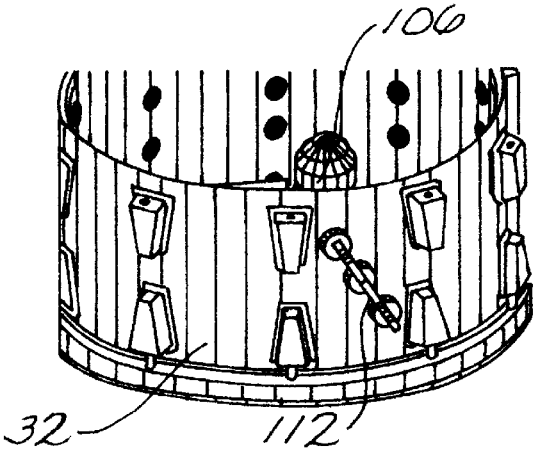

In FIGS. 13–24, there is illustrated another embodiment of the apparatus in which the microphone supporting plate is secured in place magnetically. In FIGS. 13 and 14, microphone 106 is supported on dihedral mount 107 having plate portions 108 and 109. Microphone 106 is mounted on plate portion 108 in the same manner as microphone 34 is mounted on plate portion 55 in FIG. 11 except that articulated members 89 and 90 are eliminated and the base of the microphone is pivotally connected in the clevis portion of member 88.

Magnets 111 on the inside of the drum shell 32 cooperate with magnets 112 on the outside of the shell to secure the dihedral mount 107 in place at any selected location on he drum shell. A supporting member 113 in the shape of a hand grip is secured to the magnets 112. Dihedral support 107 is preferably of non-magnetic material to give maximum efficiency to the magnetic binding of the support to the inside of the drum shell 32.

The dihedral support 107 may also be of magnetic material, e.g., iron or steel, and may be magnetized if desired. In such a construction, the internal magnets 111 may be eliminated and the support held in place solely by the magnetic pull of external magnets 112.

The use of magnets 111 and 112 (or magnets 112 and plate portion 109 if support 107 is of magnetic material) to support the microphone support 107 permits the microphone 106 to be adjusted in position both vertically and angularly as shown in FIGS. 16, 20, 21 and 22.

In FIGS. 17–24, microphone 106 is supported on dihedral mount 107 having plate portions 108 and 109. Microphone 106 is pivotally mounted on plate portion 108 as described for FIGS. 13–16.

Magnets 111 on the inside of the drum shell 32 cooperate with magnets 112 on the outside of the shell to secure the dihedral mount 107 in place at any selected location on the drum shell. A supporting member 113 in the shape of a handgrip is secured to the magnets 112. Dihedral support 107 is preferably of non-magnetic material to give maximum efficiency to the magnetic binding of the support to the inside of the drum shell 32.

The dihedral support 107 may also be of magnetic material, e.g., iron or steel, and may be magnetized if desired. In such a construction, the internal magnets 111 may be eliminated and the support held in place solely by the magnetic pull of external magnets 112, The use of magnets 111 and 112 (or magnets 112 and plate portion 109 if support 107 is of magnetic material) to support the microphone support 107 permits the microphone 106 to be adjusted in position both vertically and angulary as shown in FIGS. 17–24.

While this invention has been described fully and completely with special emphasis upon several preferred embodiments, it should be understood that within the scope of the appended claims, the invention can be practiced otherwise than as specifically described herein.

What is claimed is:

1. An electroacoustically amplified drum assembly comprising a hollow drum shell, at least one drumhead closing one end of said drum shell, a drum tensioning hoop cooperable with said drumhead, a plurality of lugs positioned around the exterior of said drum shell for connection to said tensioning hoop, each of said lugs having a bolt penetrating the wall of said drum shell for securing the lug in place, a mount positioned on the inside of but not extending through the wall of said drum shell for supporting a microphone in said drum shell spaced from and free from any connection to said drum head and having an electrical cable adapted to be connected to an external amplifier and speaker, mechanical means supporting said mount on the inside of said drum shell not requiring additional penetration of the wall of said drum shell, and said mount being operable to position said microphone in a selected position for optimizing performance.

2. An electroacoustically amplified drum assembly according to claim 1 including drumheads closing both ends of said drum shell, and a microphone supported on said mount.

3. An electroacoustically amplified drum assembly according to claim 2 in which:

said microphone mount comprises a supporting member held in place by at least one magnet on the outer surface of said drum shell.

4. An electroacoustically amplified drum assembly according to claim 2 including:

lugs spaced peripherally around said drum shell operable to receive tensioning means for adjustable tensioning drumheads on said drum shell, bolt means extending through said drum shell and securing each of said lugs thereon, and said microphone mount being secured on at least one of said lug supporting bolt means.

5. An electroacoustically amplified drum assembly according to claim 2 in which:

said mount has an articulated construction permitting adjustment and is adjustable in position in said drum shell to position said microphone in a selected position for minimizing microphone interference and optimizing proximity effect and sound quality.

6. An electroacoustically amplified drum assembly according to claim 2 in which:

said drum shell having an audio vent opening for flow of air into and out of said drum, and said cable extending to said acoustical vent opening and operatively connectable therethrough to an external amplifier and speaker.

7. An electroacoustically amplified drum assembly according to claim 6 in which:

said mount has an articulated construction permitting adjustment and is adjustable in position in said drum shell to position said microphone in a selected position for minimizing microphone interference and optimizing proximity effect and sound quality.

8. An electroacoustically amplified drum assembly according to claim 7 in which:

said microphone mount comprises a supporting member held in place by at least one magnet on the outer surface of said drum shell.

9. An electroacoustically amplified drum assembly according to claim 7 including:

lugs spaced peripherally around said drum shell operable to receive tensioning means for adjustable tensioning drumheads on said drum shell, bolt means extending through said drum shell and securing each of said lugs thereon, and said microphone mount being secured on at least one of said lug supporting bolt means.

10. An electroacoustically amplified drum assembly according to claim 6 including:

an audio vent connector supported in said audio vent opening and having a passageway for venting of air and an electrical jack receptacle connected on the inside of said drum shell to said cable and adapted to be connected on the outside of said drum shell to a jack on a cable connecting to an amplifier and speaker.

11. An electroacoustically amplified drum assembly according to claim 10 in which:

said audio vent connector comprises a hollow body portion having a cylindrical cavity, an electrical jack supported in said cavity and connectable to an outside cable jack, a hollow threaded member secured to and supporting said hollow body portion, and said hollow threaded member extending through said audio vent opening, a nut threaded on said hollow threaded member inside said drum shell securing said hollow body portion thereon, and said hollow threaded member receiving said cable for connection to said jack.

12. An electroacoustically amplified drum assembly according to claim 1 in which:

said supporting member comprises a dihedral member comprising two plate portions meeting at an obtuse angle, a one magnet adapted to be positioned on the outer surface of a drum shell in a position cooperating with said supporting member positioned on the inside of said drum shell to support said supporting member on the drum shell, one of said plate portions being positioned on the inside of said drum shell and supported by said magnet, and supporting means for said microphone on another plate portion.

13. An electroacoustically amplified drum assembly according to claim 12 including:

at least two magnets, one outside and one inside said drum shell and positioned to clamp said one plate portion against said drum shell.

14. An electroacoustically amplified drum assembly according to claim 12 in which:

said microphone supporting means has an articulated construction permitting adjustment and is adjustable in position in said drum shell to position said microphone in a selected position for optimizing performance.

15. An electroacoustically amplified drum assembly according to claim 4 in which:

said supporting member comprises a dihedral member comprising two plate portions meeting at an obtuse angle, one of said plate portions being positioned on the inside of said drum shell and supported on at least one of said lug supporting bolt means, and supporting means for said microphone on another plate portion.

16. An electroacoustically amplified drum assembly according to claim 15 in which:

said microphone supporting means has an articulated construction permitting adjustment and is adjustable in position in said drum shell to position said microphone in a selected position for optimizing performance.

17. An audio vent connector for use with a drum having a drum shell closed by at least one drum head and having a vent opening, said audio vent connector being adapted to be supported in said vent opening and having a passageway for venting of air, and an electrical jack receptacle positioned in said audio vent connector adapted to connected on the inside of a drum shell to a cable from a microphone therein and adapted to be connected on the outside of a drum shell to a jack on a cable connecting to an amplifier and speaker.

18. An audio vent connector according to claim 17 in which:

said audio vent connector comprises a hollow body portion having a cylindrical cavity, said electrical jack is supported in said cavity, a hollow threaded member secured to and supporting said hollow body portion, and said hollow threaded member extending through said vent opening when assembled on a drum, a nut threaded on said hollow threaded member when positioned inside a drum shell for securing said hollow body portion thereon, and said hollow threaded member being adapted to receive a cable from an internally positioned microphone for connection to said jack.

19. A supporting mount assembly for a microphone for an electroacoustically amplified drum assembly comprising a hollow drum shell; at least one drumhead closing an end of said drum shell, a drum tensioning hoop cooperable with said drumhead, a plurality of lugs positioned around the exterior of said drum shell for connection to said tensioning hoop, each of said lugs having a bolt penetrating the wall of said drum shell for securing the lug in place, said supporting mount assembly comprising a mount adapted to be positioned on the inside of but not extending through the wall of said drum shell for supporting an acoustical microphone therein constructed to be positioned in a drum shell spaced from and free from any connection to a drum head and having an electrical cable for connection to an external amplifier and speaker, mechanical means for supporting said mount on the inside of a drum shell not requiring additional penetration of the wall thereof, and said mount being operable to position the microphone in a selected position for optimizing performance.

20. A supporting mount assembly according to claim 19 in which:

said microphone mount comprises a supporting member, and a one magnet adapted to be positioned on the outer surface of a drum shell in a position cooperating with said supporting member positioned on the inside of said drum shell to support said supporting member on the drum shell.

21. A supporting mount assembly according to claim 20 including:

at least two magnets, adapted to be positioned one outside and one inside of a drum shell to clamp said supporting member against a drum shell.

22. A supporting mount assembly according to claim 20 in which:

said supporting member comprises a dihedral member comprising two plate portions meeting at an obtuse angle, one of said plate portions being adapted to be positioned on the inside of said drum shell and supported by said magnet, and supporting means for said microphone on another plate portion.

23. A supporting mount assembly according to claim 22 in which:

another of said plate portions has two holes therein, an electrical connector positioned and secured in one of the holes in said another plate portion and having three posts for connection to a three-wire electrical cable, a microphone support member having at one end a threaded end portion positioned in another of the holes in said another plate portion, a threaded nut member secured on said threaded end portion to hold said microphone support member securely on said another plate portion, means on said microphone support member for rotating the same on said another plate portion, said microphone support member having at another end a pivotal support, and said microphone having a pivotal supporting portion operatively connected to said pivotal support on said microphone support member.

24. A supporting mount assembly according to claim 23 in which:

said microphone is pivotally supported directly on said pivotal support on said microphone support member.

25. A supporting mount assembly according to claim 19 for use with a drum shell having lugs spaced peripherally around said drum shell operable to receive tensioning means for adjustable tensioning drumheads on said drum shell, bolt means extending through said drum shell and securing each of said lugs thereon, and said microphone mount support means having openings adapted to being secured on at least one of said lug supporting bolt means.

26. A supporting mount assembly according to claim 25 in which:

said supporting member comprises a dihedral member comprising two plate portions meeting at an obtuse angle, one of said plate portions having openings to fit on said lug supporting bolt means, and supporting means for said microphone on another plate portion.

27. A supporting mount assembly according to claim 25 in which:

another of said plate portions has two holes therein, an electrical connector positioned and secured in one of the holes in said another plate portion and having three posts for connection to a three-wire electrical cable, a microphone support member having at one end a threaded end portion positioned in another of the holes in said another plate portion, a threaded nut member secured on said threaded end portion to hold said microphone support member securely on said another plate portion, means on said microphone support member for rotating the same on said another plate portion, said microphone support member having at another end a pivotal support, and said microphone having a pivotal supporting portion operatively connected to said pivotal support on said microphone support member.

28. A supporting mount assembly according to claim 27 in which:

said microphone is pivotally supported directly on said pivotal support on said microphone support member.

29. A supporting mount assembly according to claim 27 in which:

said microphone support includes an articulated support means pivotally connected at one end to said microphone and pivotally connected at the other end to said microphone support member.

* * * * *